US012631328B2

(12) United States Patent
Buettgen

(10) Patent No.: US 12,631,328 B2
(45) Date of Patent: May 19, 2026

(54) CREMATORY VACUUM CLEANER

(71) Applicant: John J. Buettgen, Schofield, WI (US)

(72) Inventor: John J. Buettgen, Schofield, WI (US)

( * ) Notice: Subject to any disclaimer, the term of this patent is extended or adjusted under 35 U.S.C. 154(b) by 770 days.

(21) Appl. No.: 18/073,360

(22) Filed: Dec. 1, 2022

(65) Prior Publication Data

US 2024/0183528 A1 Jun. 6, 2024

(51) Int. Cl.

| | |
|---|---|
| ***A47L 9/10*** | (2006.01) |
| ***A47L 5/18*** | (2006.01) |
| ***A47L 7/00*** | (2006.01) |
| ***A47L 9/12*** | (2006.01) |
| ***A47L 9/20*** | (2006.01) |
| ***F23G 1/00*** | (2006.01) |
| ***F23J 1/02*** | (2006.01) |

(52) U.S. Cl.

CPC ..... *F23G 1/00* (2013.01); *A47L 5/18* (2013.01); *A47L 7/0071* (2013.01); *A47L 9/104* (2013.01); *A47L 9/122* (2013.01); *A47L 9/20* (2013.01); *F23J 1/02* (2013.01); *F23J 2700/003* (2013.01)

(58) Field of Classification Search

CPC ... F23G 1/00; A47L 9/104; A47L 9/02; A47L 9/122; A47L 9/10; A47L 9/102; A47L 9/106; A47L 9/12; A47L 9/125; A47L 9/127; A47L 9/20; A47L 9/32; A47L 7/0071; A47L 5/16–20; F23J 2700/003; F23J 1/06; F23J 1/02; F24B 13/006

USPC ..... 15/409; 110/194, 259, 165 R; 126/242

See application file for complete search history.

(56) References Cited

U.S. PATENT DOCUMENTS

| | | | | |
|---|---|---|---|---|
| 4,251,241 | A | 2/1981 | Bothun | |
| 4,646,482 | A | 3/1987 | Chitjian | |
| 5,961,675 | A | 10/1999 | Son et al. | |
| 6,878,189 | B2 | 4/2005 | Moredock | |
| 7,299,522 | B1 * | 11/2007 | Smith | A47L 7/0038 15/409 |
| 7,632,324 | B2 | 12/2009 | Makarov et al. | |
| 8,291,545 | B2 | 10/2012 | Ivarsson et al. | |

(Continued)

OTHER PUBLICATIONS

Crematory Vacuum Device displayed at Funeral Directors Association gathering in Salt Lake City on Oct. 14-17, 2018 by John J. Buettgen.

(Continued)

*Primary Examiner* — Michael A Gump
(74) *Attorney, Agent, or Firm* — Stiennon & Stiennon

(57) ABSTRACT

A vacuum cleaner for use in cleaning very hot crematory ovens has a suction head mounted on side wheels, and connected to a central fitting which receives compressed air through a stiff metal air supply pipe. An expansion pipe extends upwardly from the central fitting and is tipped frontwardly. The compressed air passes through the central fitting which incorporates a vacuum eductor which draws air flow in from the vacuum head. The hot air discharges through a filter cap at the upper end of the expansion pipe which retains a filter assembly of multiple screens against the upper end of the expansion pipe. Dust and small particles pass through the filter assembly to be carried away by hot air up the crematory chimney. Larger particles are retained by the filter assembly, and may be discharged downwardly from the vacuum head into a receptacle when the input compressed air is discontinued.

18 Claims, 4 Drawing Sheets

(56) References Cited

U.S. PATENT DOCUMENTS

| | | | | |
|---|---|---|---|---|
| 2015/0208887 | A1* | 7/2015 | Moore | A47L 7/0071 134/21 |
| 2015/0335217 | A1* | 11/2015 | Fritsche | A47L 5/24 134/10 |
| 2017/0079493 | A1* | 3/2017 | Genn | A47L 9/0477 |
| 2020/0375422 | A1* | 12/2020 | Romero | A47L 7/0014 |

OTHER PUBLICATIONS

"Line Vac TM (Aluminum) Installation and Maintenance," Copyright 2015 Exair Corporation, Cincinnati, OH, Aug. 10, 2015.
"Adjustable E-VAC Installation and Maintenance," Copyright 2016 Exair Corporation, Cincinnati, OH, Sep. 26, 2016.
Nortech N551DCNED 55-Gallon Static Conductive Drum "V" Vacuum Kits . . . , Construction Equipment & Supply Company, http://www.sand-blasters.net/nortechn551dcned55-gallonstatic-conductivedrumdvacuumkitswith1-12vacuumhoseandvacuumtoolkits.aspx, downloaded Jun. 30, 2023.

* cited by examiner

CREMATORY VACUUM CLEANER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to crematory equipment generally, and more particularly to vacuum cleaners for cleaning out crematory ovens at temperatures of 1,800° F. or more.

The body of a deceased person or decedent is cremated in a special crematory oven which must be operated at high temperatures. Once a body has been cremated the ash and remaining bone fragments are raked or brushed out of the crematory oven and the fragments are ground into small particles which are placed with the ash in an urn which is presented to the decedent's family or heir. Once a body has been cremated it is most economical to cremate another body in the oven without waiting for the oven to cool, both to maximize the use of the oven and to avoid having to reheat the oven from a cold start.

Although decedents are cremated one after another in the same crematory oven, it is important, to the extent possible, to avoid comingling the remains of one decedent with that of another. The usual tools for clearing remains from the oven are a crematory rake—which consists of a flat metal blade on the end of a pole—and a metal brush. These tools are used to bring the remains to a receptacle placed near or adjacent to the crematory door. However, with extended use it is common for the inner bricks which line the crematory oven to fracture or develop spaces or gaps between them. With a conventional rake and brush, these gaps can be difficult to completely clean and it can be difficult to effectively remove the remains of one decedent before the next decedent is cremated.

While it is known to use a vacuum cleaner for such purposes, existing vacuum cleaners are limited to a temperature of about 900° F. Such vacuum cleaners bring the air containing silica dust to a canister located outside the crematory oven where it can be released into the air unless a filter such as a HEPA filter is used to remove respirable dust. It is also known to use a Venturi mounted to a vacuum cleaner canister to provide a vacuum of greater strength such as sometimes is used for industrial cleaning.

What is needed is a vacuum cleaner capable of being used at extremely high temperatures of up to 1800° F. or more with high suction to remove the ashes and bone fragments which are too small to be removed by a rake or metal brush from a crematory oven.

SUMMARY OF THE INVENTION

The crematory vacuum cleaner of this invention has a rigid tubular handle about nine feet long which is connected to a source of pressurized air at one end, and to a central fitting at the other end. The central fitting connects an air inlet to a plenum which carries pressurized air from the rigid tubular handle to a plurality of openings surrounding a central suction chamber. The openings are directed to discharge air away from a suction head connected below the central fitting. This airflow creates a region of reduced pressure, such as in a vacuum eductor, and this reduced pressure region draws air from the suction head below. The suction head is mounted on wheels, supporting the weight of the device with the long tubular handle. An expansion pipe extends upwardly from the central fitting and has an internal expansion chamber which increases in diameter as it extends upwardly from the central fitting. The expansion pipe is terminated by a cap which overlies the expansion pipe outlet. The cap retains a filter assembly of layered fire-resistant screens. The filter assembly is retained by the cap such that the air flow from the expansion pipe passes through the filter assembly and the cap, and retains particles above a selected size while allowing particles below the selected size to pass through. The expansion pipe is tipped away from the rigid tubular handle such that the air flow is discharged through the cap in a direction having a horizontal component away from the rigid tubular handle.

As all parts of the device may be constructed of high temperature materials. The vacuum cleaner thus constructed can be operated within the high temperature environment of the crematory oven, without the necessity of requiring significant cooling between cremations.

The exhaust of the vacuum cleaner is drawn up the crematory oven chimney by convection, venting the dust collected by the vacuum head, and thereby preventing any significant amount of dust from exiting the crematory oven door.

It is an object of the present invention to provide a vacuum cleaner for use within a crematory oven which can operated at very high temperatures.

It is another object of the present invention to provide a vacuum cleaner which can disperse small dust particles up a chimney, while retaining larger particles for collection.

It is a further object of the present invention to provide a tool for better removing the ashes and bone fragments from the retort in which a body is cremated.

Further objects, features and advantages of the invention will be apparent from the following detailed description when taken in conjunction with the accompanying drawings.

DESCRIPTION OF THE PREFERRED EMBODIMENTS

Figure 1:
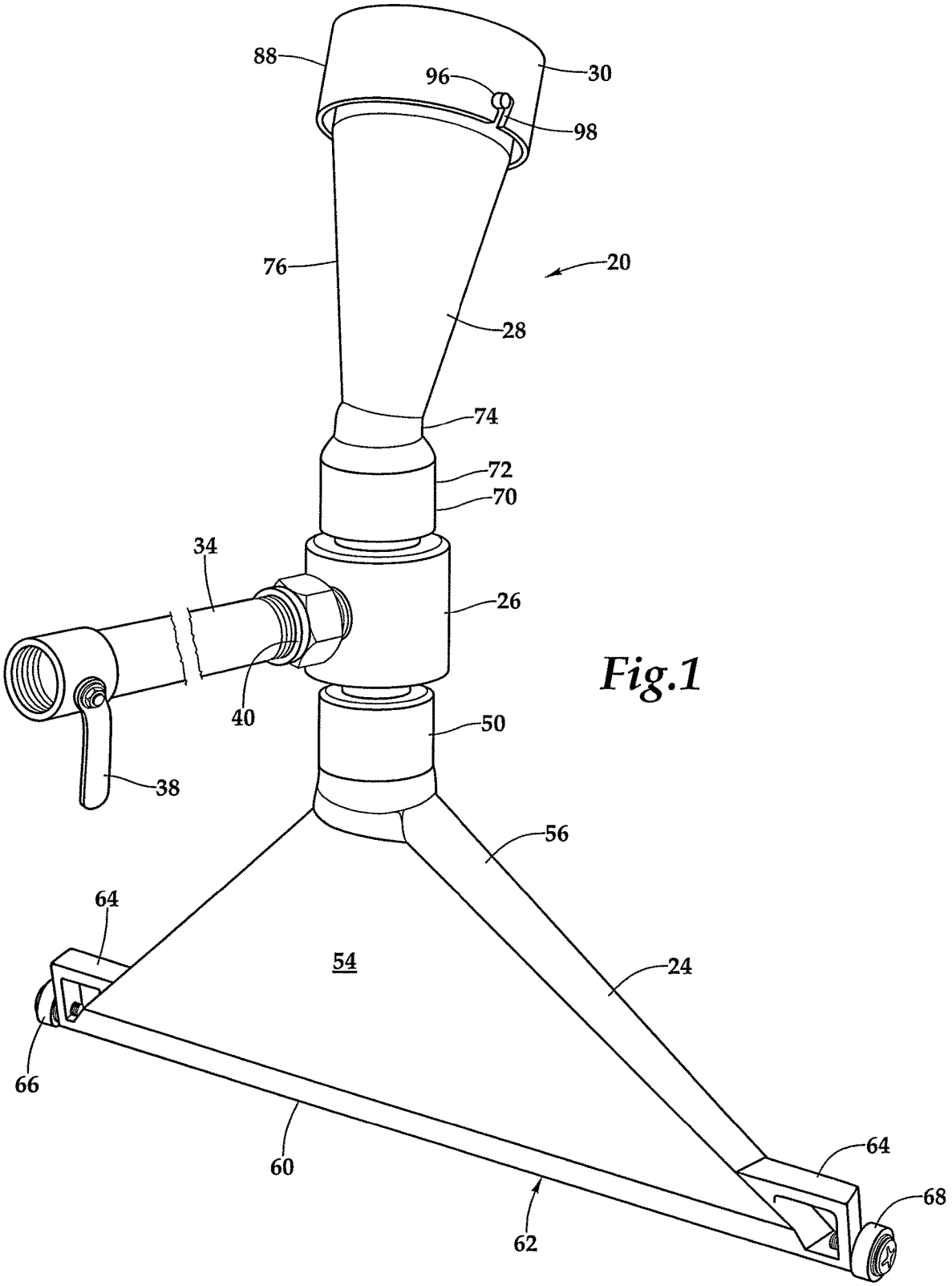
FIG. 1 is an isometric view of a crematory vacuum cleaner of this invention.
Figure 2:
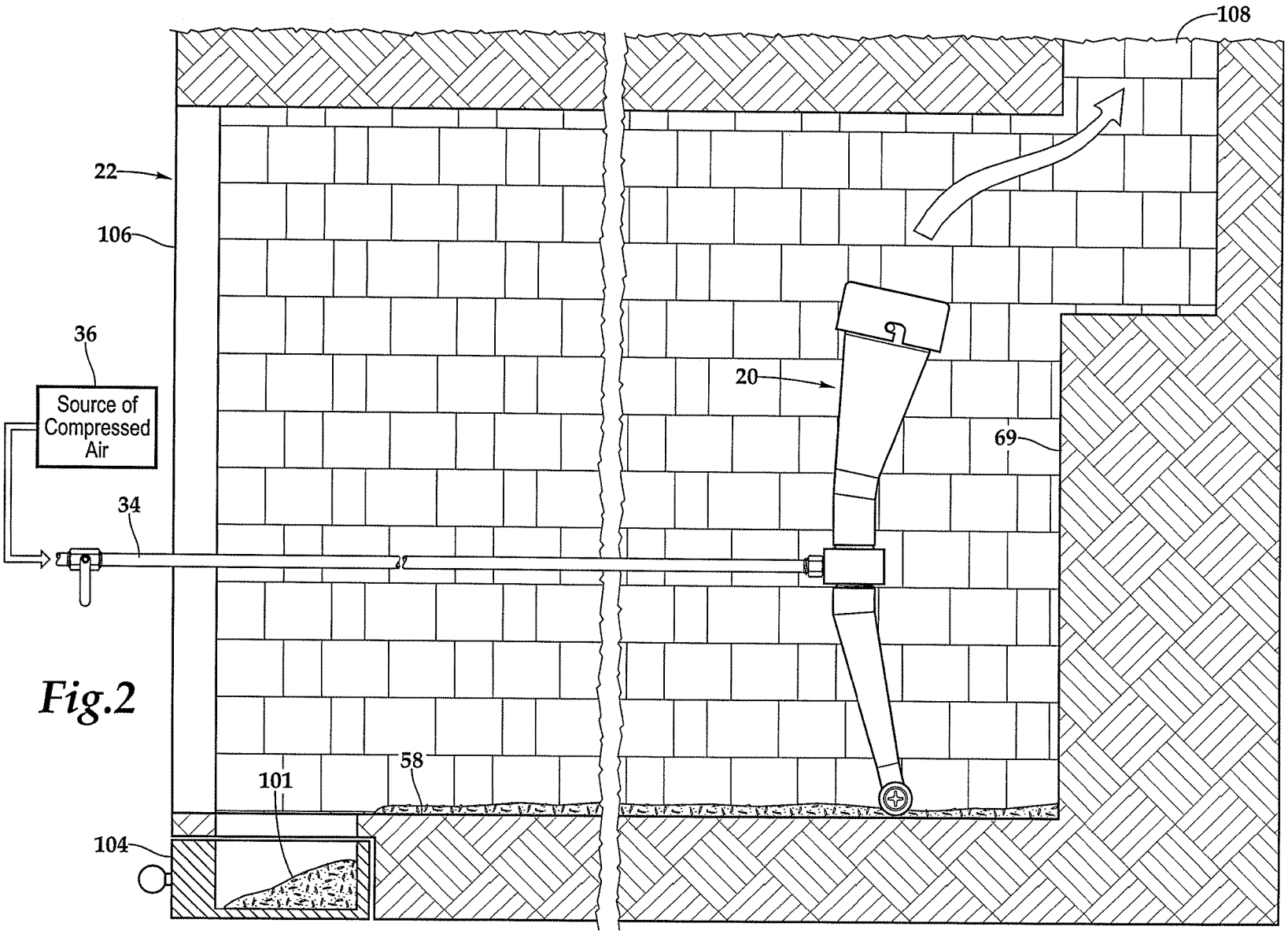
FIG. 2 is a side elevational view of the crematory vacuum cleaner of FIG. 1 in operation within a crematory oven.

Referring more particularly to FIGS. 1-5, wherein like numbers refer to similar parts, a crematory vacuum cleaner 20 is used within a crematory oven shown in FIG. 2. The crematory vacuum cleaner 20 has a suction head 24 connected to a central fitting 26 incorporating a vacuum eductor followed by an expansion pipe 28 having a filter cap 30 which retains a filter assembly 32 within the expansion pipe which retains larger fragments while allowing smaller particles to escape upwardly. A rigid tubular extension handle 34 is rigidly connected to the central fitting 26 and allows an operator to effectively maneuver the suction head 24 within the high temperature interior of the crematory oven 22 while the operator is sufficiently distant from the extreme heat. The handle 34 may be fabricated of a heat resistant material such as refractory metal such as black iron or titanium and is more than six feet long, preferably as much as nine feet long. The handle may be connected by a flexible hose (not shown) to a source of compressed air 36 such as a 20-60 gallon compressor tank connected to an air compressor. The large tank allows a small air compressor to supply a relatively high air pressure of 20, 40, 60, 80, or over 100 psi as needed. A valve control handle 38 is positioned inline between the extension handle 34 and the source of compressed air 36 to allow the selective activation and deactivation of the crematory vacuum cleaner 20.

Figure 3:
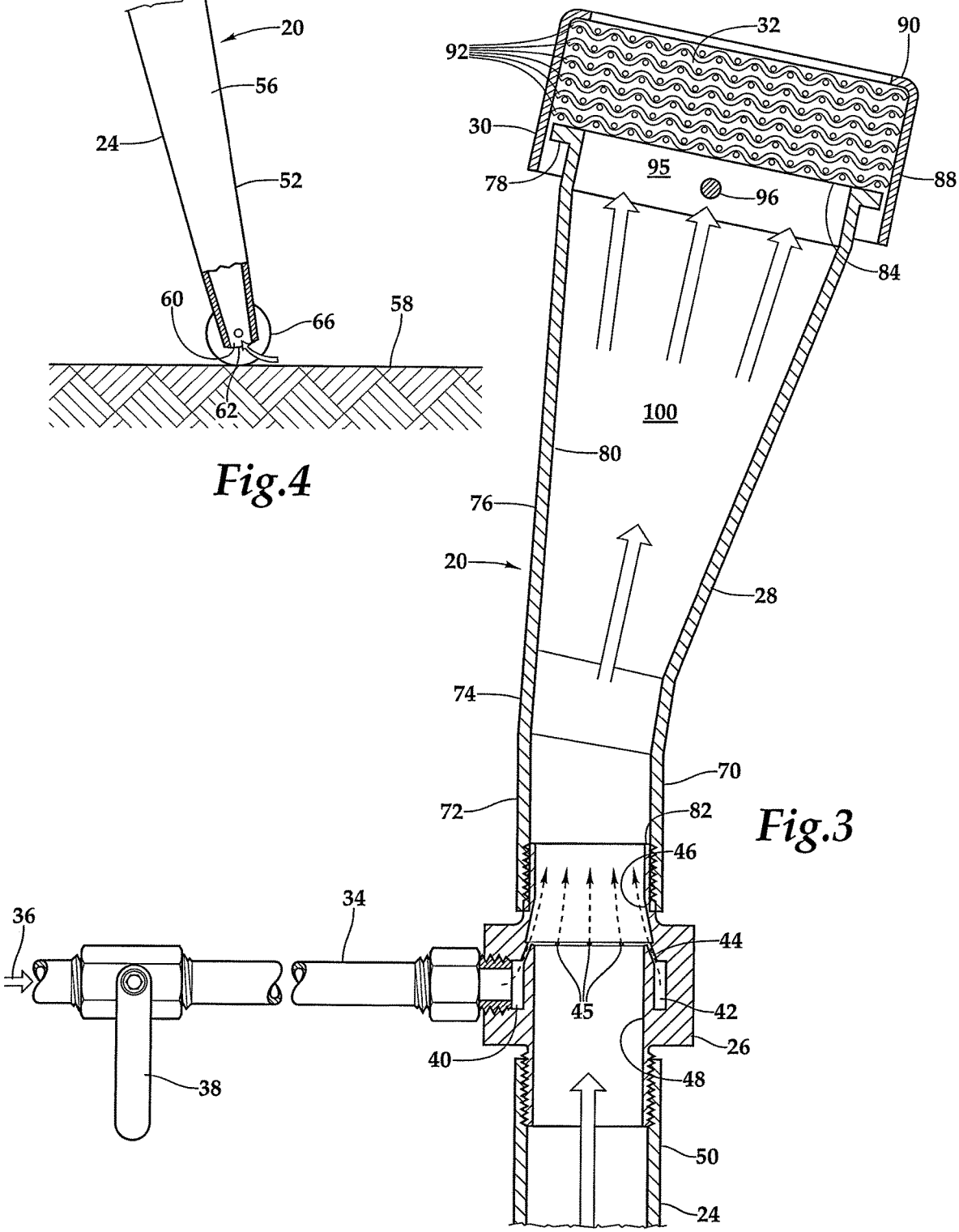
FIG. 3 is an enlarged fragmentary cross-sectional view of the crematory vacuum cleaner of FIG. 2, with the air and particle flow therethrough schematically indicated.

As shown in FIG. 3, the central fitting 26 may be a vacuum eductor, sometimes also called an ejector, such as a conventional LINE VAC™ airflow accelerator module available from Exair Corporation, 11510 Goldcoast Dr., Cincinnati, OH. The conventional LINE VAC™ device may be modified by drilling the ports to be slightly larger than the stock part. The central fitting 26 has an inlet 40 with a threaded connection to receive the extension handle 34. The inlet 40 communicates with an annular plenum 42 which encircles the central fitting 26. A plurality of nozzles 44 extend from the plenum and are inclined inwardly and are directed downstream towards the expansion pipe 28. The nozzles 44 have exit ports 45 which are spaced around a converging segment 46 of the central fitting 26 and discharge the compressed air into a suction chamber 48 that extends axially through the central fitting. The air discharged from the nozzles 44 forms jets of air which serve to create a region of reduced pressure which draws air in from the generally cylindrical suction chamber 48 which is disposed upstream of the ports 45.

Figure 4:
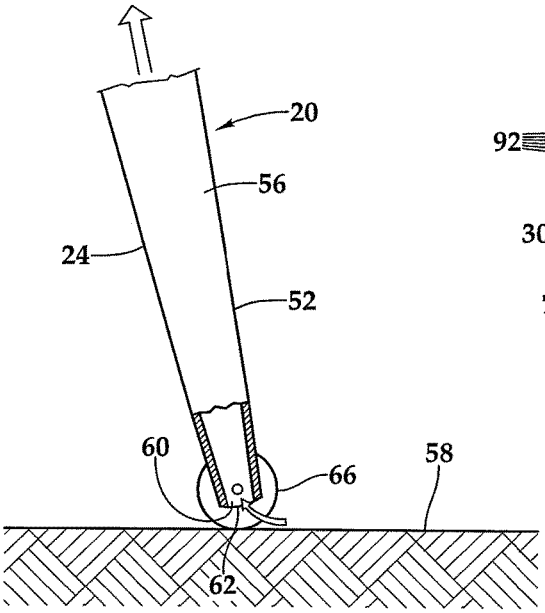
FIG. 4 is a fragmentary cross-sectional of the crematory vacuum cleaner of FIG. 1 showing the vacuum head inlet spaced above the crematory oven bottom wall by supporting wheels.

The suction head 24 has a threaded fitting 50 which is connected to the central fitting 26. The suction head 24, as shown in FIG. 1, has a front wall 52 spaced from a rear wall 54 by two side walls 56 to form a duct through which particles may be vacuumed from the floor 58 of the crematory oven 22 and conveyed upwardly. The front wall 52, rear wall 54 and side walls 56 are terminated by a lower lip 60, as shown in FIG. 4, which defines a suction head inlet 62 which may be about 14 inches wide.

Brackets 64 extend sidewardly from the side walls 56 of the suction head at its lower end, and provide vertical structure to which a first wheel 66 and a second wheel 68 are mounted on opposite sides of the inlet 62. The free-wheeling wheels 66, 68 extend downwardly beyond the lower lip 60 of the suction head to engage the crematory oven floor 58 and to space the lower lip above the floor over which the wheels travel. The wheels 66, 68 function to maintain a gap between the floor 58 and the lower lip to allow air to be drawn upwardly into the suction head inlet 62. The gap is preferably ⅛ to ¼ inch. As shown in FIG. 2, the suction head 24 extends frontwardly from the central fitting such that the lip 60 is positioned frontwardly of the central fitting on a side of the central fitting away from the rigid tubular handle 34. This allows the device 20 to be advanced into the crematory oven 22 to allow material to be vacuumed up which is close to the far wall 69 of the oven.

The expansion pipe 28 may be mounted to the central fitting 26 by a base section 70 which has a threaded connection, as shown in FIG. 3. The base section 70 has a first part 72 which extends vertically along the same axis as the central fitting suction chamber 48. A second part 74 of the base section extends upwardly and is tilted frontwardly from the first part 72. The centerline of the second part 74 is inclined away from the inlet 40 about 5 to 20 degrees from the vertical, preferably 10 to 12 degrees. A frustoconical section 76 of the expansion pipe projects from the second part 74 and extends upwardly and away from the extension handle 34. The frustoconical section 76 is terminated at its upper end by a narrow cylindrical segment 95 with an outwardly extending flange 78, as shown in FIG. 3. The expansion pipe may be about 6¾ inches tall as measured vertically. The expansion pipe 28 has an internal expansion chamber 80 which increases in diameter as it extends upwardly away from an inlet 82 at the central fitting to an upper outlet 84. The inlet 82 of the expansion chamber 80 may have a diameter of about 1¼ inches, and the outlet may have a diameter of about 2½ inches.

The metal cap 30 is connected to overlie the expansion pipe outlet 84. The cap 30 has a cylindrical skirt 88 which terminates at an upper annular flange 90. The flange 90 extends radially inwardly and defines a circular opening. The cap 30 may be provided with a plurality of screens or grills 92 which are positioned between the cap flange 90 and the are positioned in the space between the flange 90 and the upper flange 78 of the expansion pipe. The grills 92 are fabricated of fire-resistant metal and are oriented so the grill wires crisscross one another. Thus the particles which can fully pass through the filter assembly will be smaller than the screen openings in any single grill. The grills 92 define a filter assembly 32 which is capable of functioning at the very high temperatures experienced within the crematory oven. The filter assembly 32 is selected to allow air and dust particles to pass through, while retaining larger fragments such as bone and metal. The cap 86 is releasably connected to the expansion pipe 28, for example by a bayonet mount having two pins 96 which extend radially outwardly from the upper portion of the expansion pipe 76 and selectively engaged with two inverted L-shaped receptor slots 98 formed in the skirt 88 of the cap 30. The pins 96 may be formed as a single rod which is passed through the upper end of the expansion pipe 28.

Figure 5:
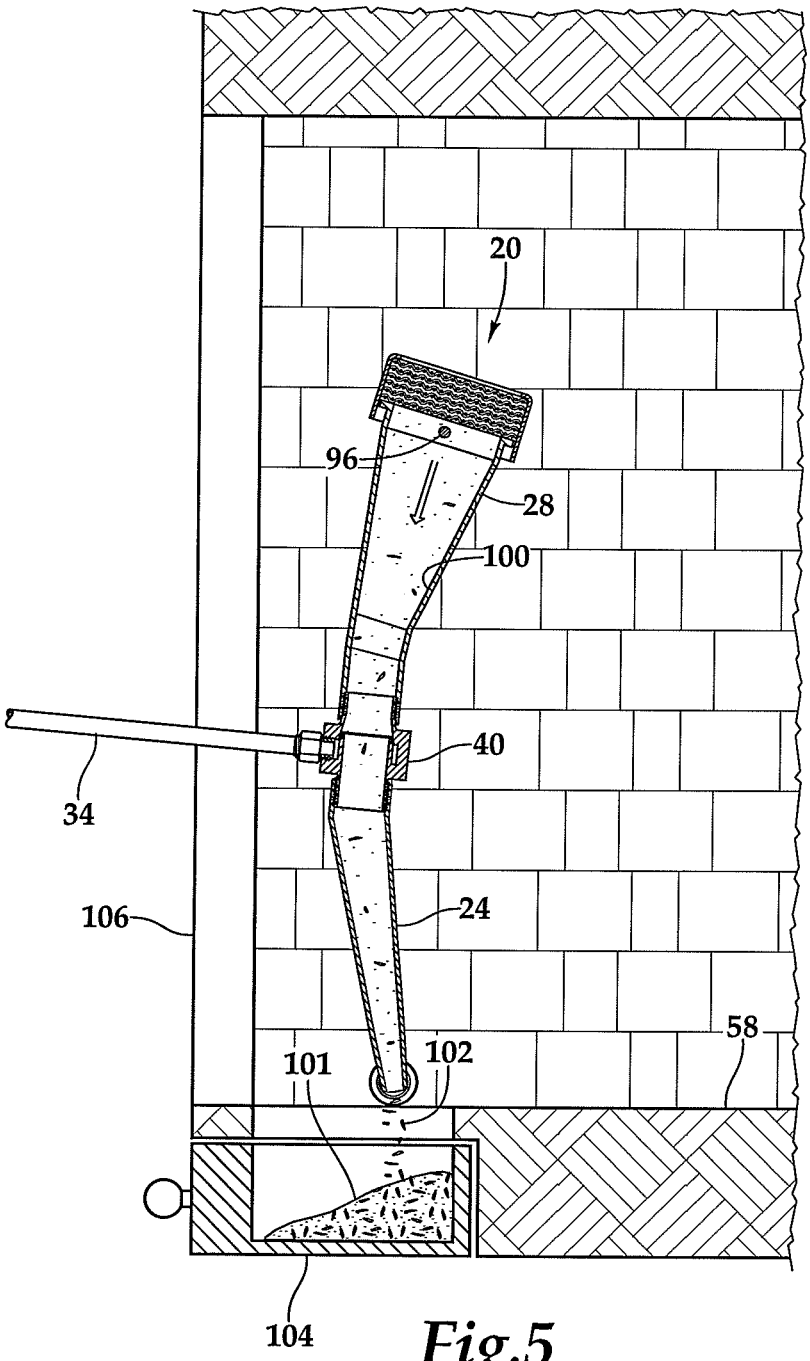
FIG. 5 is a cross-sectional view of the crematory vacuum cleaner of FIG. 1 with the flow of compressed air to the device halted such that larger fragments held against a filter assembly are free to pass downwardly through an unobstructed passageway to exit the suction head and be received within a collection box.

As shown in FIGS. 3 and 5, the crematory vacuum cleaner 20 has an unobstructed passageway 100 which extends from the suction head inlet 62, through the central fitting 26 and the expansion pipe expansion chamber 80 to the filter assembly. This unobstructed passageway 100 provides a reversible pathway for particles brought into the device through the suction head inlet 62, such that when pressurized air is no longer supplied to the central fitting 26, the larger fragments 102 (that is particles which were too large to pass through the filter assembly and were thus engaged with the filter assembly within the passageway) may then drop down through the unobstructed passageway to exit the device at the suction head inlet 62.

The crematory vacuum 20 is a large tool, because it must be long enough to clean out the entire length of the crematory oven 22, which is large enough to accommodate the full range of decedents. The extension handle 34 being a rigid tube may be supported on hooks alongside the crematory oven. The operation of the device is shown in FIGS. 3 and 5. After cremation, the main portion 101 of the cremated remains are raked from the oven interior with a rake into a collection container 104 located near the entrance 106 to the oven 22. The crematory vacuum 20 is then introduced into the oven with the wheels 66, 68 supporting the weight of the long extension handle 34. The valve control handle 38 is actuated to connect the source of compressed air 36 to the vacuum eductor central fitting 26, thereby creating an upwardly directed flow of air which draws the cremated remains into the unobstructed passageway 100 through the suction head inlet 62. Dust and fine particles are carried upwardly through the device and pass through the filter assembly 32. Because the interior of the crematory oven is very hot, the air drawn through the passageway is also hot and will tend to rise, carrying the exhaust dust up the crematory oven chimney 110. Fragmentary remains 102 which are too large to pass through the screen openings of the grills will be retained against the filter assembly 32. These larger remains 102 are collected along with the main portion of the remains in the collection container 104 by withdrawing the extension handle 34 and positioning it over the collection container and operating the valve control handle 38 to discontinue the supply of compressed air to the central fitting 26. With no supply of compressed air, the upward air flow ceases, and the larger fragments can then fall under the effect of gravity and perhaps shaking of the device down through the unobstructed passageway and into the collection container 104.

Other vacuum generators that use Venturis may be employed in the central fitting 26 to create the region of low pressure within the central fitting. A Venturi works by accelerating a stream of compressed air through a converging and diverging section so that the accelerated air, using the Bernoulli effect, creates a vacuum which is led to the suction head which draws air into the airstream which is then slowed by passing through the diverging section of the Venturi.

It is understood that the invention is not limited to the particular construction and arrangement of parts herein illustrated and described, but embraces all such modified forms thereof as come within the scope of the following claims.

I claim:

1. A crematory vacuum device comprising:

a rigid tubular handle having a conduit therethrough for connection to a source of pressurized air;

a central fitting connected to the rigid tubular handle at an inlet, the central fitting having a cylindrical interior surface defining a vertical longitudinal axis with respect to the cylindrical interior surface and having a plenum connected to the inlet, the plenum carrying pressurized air from the rigid tubular handle to a plurality of openings surrounding a central suction chamber and directed to discharge air away from a suction head connected to the central fitting and extending downwardly therefrom, such that said discharged air draws air from the suction head;

an expansion pipe connected to the central fitting above the suction head, the expansion pipe having an internal frustoconical expansion chamber which extends from an inlet area having a center to an outlet area having a center, wherein an expansion chamber axis is defined extending between the center of the inlet area and the center of the outlet area, wherein the expansion chamber axis is tipped away from the vertical axis of the central fitting and away from the rigid tubular handle, wherein the frustoconical expansion chamber increases in diameter as it extends upwardly away from an inlet of the expansion pipe at the central fitting to an upper outlet;

a cap which is connected to overlie the expansion pipe outlet; and a filter assembly engaged with portions of the cap and retained by the cap such that air flow from the expansion pipe passes through the filter assembly and the cap, the filter assembly thereby retaining particles above a selected size while allowing particles below the selected size to pass through, wherein the expansion pipe is tipped away from the rigid tubular handle such that the air flow is discharged through the cap in a direction having a horizontal component away from the rigid tubular handle.

2. The crematory vacuum device of claim 1 further comprising:

portions of the suction head which define a lower lip which surrounds a suction head inlet;

a first wheel mounted to the suction head on one side of the suction head inlet; and a second wheel mounted to the suction head on an opposite side of the suction head inlet, wherein the first wheel and the second wheel extend downwardly beyond the lower lip of the suction head to thereby space the lower lip above a surface over which the wheels travel to retain a gap between said surface and the lower lip to allow air to be drawn upwardly into the suction head inlet.

3. The crematory vacuum device of claim 1 wherein the suction head extends frontwardly from the central fitting such that a lip is positioned frontwardly of the central fitting on a side of the central fitting away from the rigid tubular handle.

4. The crematory vacuum device of claim 1 wherein the cap has a side wall with at least one opening therein, and wherein a pin extends from the expansion pipe to engage said at least one opening to selectively retain the cap and the filter assembly connected to the expansion pipe.

5. The crematory vacuum device of claim 1 wherein the rigid tubular handle is at least six feet long.

6. The crematory vacuum device of claim 1 wherein portions of the suction head define a lower lip which surrounds a suction head inlet, and wherein an unobstructed passageway is defined running from the suction head inlet, through the central fitting and the expansion chamber to the filter assembly, the unobstructed passageway providing a reversible pathway for particles brought into the device through the suction head inlet, such that when pressurized air is no longer supplied to the central fitting, particles engaged with the filter assembly may drop down through the unobstructed passageway to exit the device at the suction head inlet.

7. The crematory vacuum device of claim 1 wherein the filter assembly comprises a plurality of screens stacked one over the other.

8. A crematory vacuum device comprising:

a rigid tubular handle having a conduit therethrough for connection to a source of pressurized air;

a central fitting comprising a vacuum eductor and fixed to the rigid tubular handle at an inlet, the central fitting thus receiving pressurized air at the inlet to discharge air away from a suction head connected to the central fitting and extending downwardly therefrom, such that said discharged air draws air from the suction head, the central fitting having a cylindrical interior surface defining a vertical longitudinal axis with respect to the cylindrical interior surface;

an expansion pipe connected to the central fitting above the suction head, the expansion pipe having an internal frustoconical expansion chamber which extends from an inlet area having a center to an outlet area having a center, which an expansion chamber axis is defined extending between the center of the inlet area and the center of the outlet area, wherein the expansion chamber axis is tilted forwardly from the central fitting vertical longitudinal axis and away from the rigid tubular handle, wherein the expansion chamber increases in diameter as it extends upwardly away from an inlet of the expansion pipe at the central fitting to an upper outlet;

a cap which is connected to overlie the expansion pipe outlet; and a filter assembly engaged with portions of the cap and retained by the cap such that air flow from the expansion pipe passes through the filter assembly and the cap, the filter assembly thereby retaining particles above a selected size while allowing particles below the selected size to pass through, wherein the expansion pipe is tipped away from the rigid tubular handle such that the air flow is discharged through the cap in a direction having a horizontal component away from the rigid tubular handle.

9. The crematory vacuum device of claim 8 further comprising:

portions of the suction head which define a lower lip which surrounds a suction head inlet, wherein the suction head extends frontwardly from the central fitting such that the lower lip is positioned frontwardly of the central fitting on a side of the central fitting away from the rigid tubular handle, allowing the device to be advanced into a crematory oven to allow material to be vacuumed up which is close to a far wall of the crematory oven;

a first wheel mounted to the suction head on one side of the suction head inlet; and a second wheel mounted to the suction head on an opposite side of the suction head inlet, wherein the first wheel and the second wheel extend downwardly beyond the lower lip of the suction head to thereby space the lower lip above a surface over which the wheels travel to retain a gap between said surface and the lower lip to allow air to be drawn upwardly into the suction head inlet.

10. The crematory vacuum device of claim 8 wherein the suction head extends frontwardly from the central fitting such that a lip is positioned frontwardly of the central fitting on a side of the central fitting away from the rigid tubular handle.

11. The crematory vacuum device of claim 8 wherein the cap has a side wall with at least one opening therein, and wherein a pin extends from the expansion pipe to engage said at least one opening to selectively retain the cap and the filter assembly connected to the expansion pipe.

12. The crematory vacuum device of claim 8 wherein the filter assembly comprises a plurality of overlapping screens.

13. A crematory vacuum device comprising:

a rigid tubular handle having a conduit therethrough for connection to a source of pressurized air;

a central fitting comprising a vacuum eductor and fixed to the rigid tubular handle at an inlet, the central fitting thus receiving pressurized air at the inlet to discharge air away from a suction head connected to the central fitting and extending downwardly therefrom, such that said discharged air draws air from the suction head;

an expansion pipe connected to the central fitting above the suction head, the expansion pipe having an internal expansion chamber which increases in diameter as it extends upwardly away from an inlet of the expansion pipe at the central fitting to an upper outlet;

a cap which is connected to overlie the expansion pipe outlet;

a filter assembly engaged with portions of the cap and retained by the cap such that air flow from the expansion pipe passes through the filter assembly and the cap, the filter assembly thereby retaining particles above a selected size while allowing particles below the selected size to pass through, wherein the expansion pipe is tipped away from the rigid tubular handle such that the air flow is discharged through the cap in a direction having a horizontal component away from the rigid tubular handle; and wherein portions of the suction head define a lower lip which surrounds a suction head inlet, and wherein an unobstructed passageway is defined running from the suction head inlet, through the central fitting and the expansion chamber to the filter assembly, the unobstructed passageway providing a reversible pathway for particles brought into the device through the suction head inlet, such that when pressurized air is no longer supplied to the central fitting, particles engaged with the filter assembly may drop down through the unobstructed passageway to exit the device at the suction head inlet.

14. A crematory vacuum device comprising:

a rigid tubular handle having a conduit therethrough for connection to a source of pressurized air;

a central fitting connected to the rigid tubular handle at an inlet, the central fitting having passageways therein which receive the pressurized air introduced at the inlet and direct it to produce a region of lowered pressure within the central fitting;

a suction head connected to the central fitting and extending downwardly therefrom, such that said region of lowered pressure draws air from the suction head, and wherein the suction head has a lower inlet through which air and particles are drawn into the device;

an expansion pipe connected to the central fitting above the suction head, the expansion pipe having an internal expansion chamber which increases in diameter as it extends upwardly away from an inlet of the expansion pipe at the central fitting to an upper outlet;

a filter assembly engaged with the expansion pipe and retained therein, wherein air flow from the expansion pipe passes through the filter assembly and particles above a selected size are retained against the filter assembly, while particles below the selected size may pass through the filter assembly; and wherein an unobstructed passageway is defined running from the suction head inlet, through the central fitting and the expansion chamber to the filter assembly, the unobstructed passageway providing a reversible pathway for particles brought into the device through the suction head inlet, such that when pressurized air is no longer supplied to the central fitting, particles engaged with the filter assembly may drop down through the unobstructed passageway to exit the device at the suction head inlet.

15. The crematory vacuum device of claim 14 further comprising:

portions of the suction head which define a lower lip which surrounds the suction head inlet;

a first wheel mounted to the suction head on one side of the suction head inlet; and a second wheel mounted to the suction head on an opposite side of the suction head inlet, wherein the first wheel and the second wheel extend downwardly beyond the lower lip of the suction head to thereby space the lower lip above a surface over which the wheels travel to retain a gap between said surface and the lower lip to allow air to be drawn upwardly into the suction head inlet.

16. The crematory vacuum device of claim 14 wherein the suction head extends frontwardly from the central fitting such that a lip is positioned frontwardly of the central fitting on a side of the central fitting away from the rigid tubular handle.

17. The crematory vacuum device of claim 14 wherein the filter assembly comprises a plurality of screens engaged with the expansion pipe and retained therein by a cap which is releasably secured to the expansion pipe.

18. The crematory vacuum device of claim 14 wherein the expansion pipe is tipped away from the rigid tubular handle such that the air flow is discharged through the expansion pipe outlet in a direction having a horizontal component away from the rigid tubular handle.

* * * * *